US012751547B2

(12) United States Patent
Fritze

(10) Patent No.: US 12,751,547 B2
(45) Date of Patent: Oct. 6, 2026

(54) MODULAR CHAIR AND METHOD FOR MAKING SAID MODULAR CHAIR

(71) Applicant: DV8 ID S.R.L., Milan (IT)

(72) Inventor: Torsten Fritze, Milan (IT)

(73) Assignee: DV8 ID S.R.L., Milan (IT)

( * ) Notice: Subject to any disclaimer, the term of this patent is extended or adjusted under 35 U.S.C. 154(b) by 105 days.

(21) Appl. No.: 18/682,849

(22) PCT Filed: Aug. 12, 2021

(86) PCT No.: PCT/IB2021/057441
§ 371 (c)(1),
(2) Date: Feb. 9, 2024

(87) PCT Pub. No.: WO2023/017300
PCT Pub. Date: Feb. 16, 2023

(65) Prior Publication Data

US 2024/0341481 A1 Oct. 17, 2024

(51) Int. Cl.
*A47C 4/02* (2006.01)
*A47C 7/22* (2006.01)
*A47C 13/00* (2006.01)

(52) U.S. Cl.
CPC ..... *A47C 4/021* (2013.01); *A47C 7/22* (2013.01); *A47C 13/005* (2013.01)

(58) Field of Classification Search
CPC .. A47C 5/06; A47C 4/30; A47C 31/02; A47C 7/28
See application file for complete search history.

(56) References Cited

U.S. PATENT DOCUMENTS 2,830,350 A 4/1958 Wootton
3,752,209 A 8/1973 Swanson
(Continued)

FOREIGN PATENT DOCUMENTS

DE 102014003099 A1 * 9/2015 ..... D04B 1/22
EP 2319967 A1 * 5/2011 ..... A47C 7/282
(Continued)

OTHER PUBLICATIONS

International Search Report for PCT/IB2021/057441 mailed May 17, 2022, 3 pages.
(Continued)

*Primary Examiner* — Justin Michael Heston
(74) *Attorney, Agent, or Firm* — NIXON & VANDERHYE

(57) ABSTRACT

It is provided a modular chair (1) comprising a support structure including a frame (2) developing at least in part along a expansion trajectory (2*a*), a membrane (3) including a support surface (30) suitable for allowing the support of a user, an edge (31) capable of being at least partially constrained to said frame (2) and a tubular guide (32) arranged in correspondence with the edge (31), a cursor (4) defining an extension direction (4*a*) parallel at least partially with respect to the expansion trajectory (2*a*) and housed within at least part of the guide (32), wherein the frame (2) includes at least a protrusion (20) protruding in the incident direction with respect to the expansion trajectory (2*a*), and the slider (4) includes at least a receiving portion (40) configured to at least partially house the protuberance (20) in such a way as to rigidly constrain, in correspondence with at least one fixed point, the frame (2), the membrane (3) and the slider (4).

12 Claims, 9 Drawing Sheets

(56) References Cited

U.S. PATENT DOCUMENTS

Figure 1:
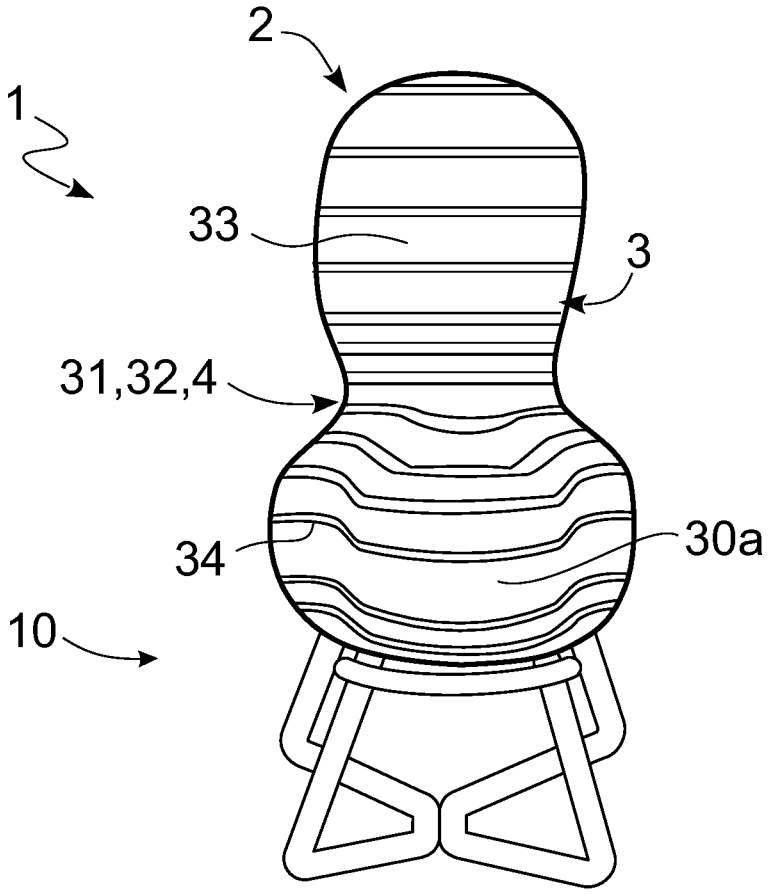

| | | | | |
|---|---|---|---|---|
| 6,227,010 | B1 * | 5/2001 | Roell | D04B 1/104 66/170 |
| 11,918,125 | B2 * | 3/2024 | Fritze | A47C 5/06 |

FOREIGN PATENT DOCUMENTS

| | | | | |
|---|---|---|---|---|
| KR | 20090013172 | U * | 12/2009 | A47C 31/023 |
| WO | 2020115627 | A1 | 6/2020 | |

OTHER PUBLICATIONS

Written Opinion of the ISA for PCT/IB2021/057441 mailed May 17, 2022, 5 pages.

* cited by examiner

MODULAR CHAIR AND METHOD FOR MAKING SAID MODULAR CHAIR

This application is the U.S. national phase of International Application No. PCT/IB2021/057441 filed Aug. 12, 2021 the entire contents of which are hereby incorporated by reference.

The present invention relates to a modular chair and method of manufacturing said modular chair of the type specified in the preamble of the first claim.

In particular, the present invention relates to a modular chair, or interlocking, in the broadest sense of the term, that is any device that allows a user to sit and which can, depending on the configuration, consist of a chair, an armchair, sofa or other for various types of applications including office, home, garden, luxury or more such as, for example, cars, airplanes, applications in the medical field such as wheelchairs, and in the field of children's chairs.

As is known, in the current state of the art, many different types of chairs have been produced, for example with armrests, recliners, slings, or armchairs or sofas or so on, depending on the reference market for which said chairs are intended.

Historically, chairs or seats derive from the simplest benches. The latter are in fact equipped with a simple support surface defining the seat structurally constrained to at least two support pillars designed to allow the seat to be raised above the floor. At present, the chairs are typically adapted to allow the support of at least one user, and preferably one, on a surface called a sitting. Most of the chairs also have additional support elements, such as the backrest, and may also include armrests and supports for supporting the upper and lower limbs respectively.

Among the various most common types of chairs it is possible to identify the so-called deck chair, consisting of a folding chaise lounge whose backrest can be reclined with variable angles and on which it is possible to assume a sitting or lying position, as desired by the user, the curule chair, also developed in faldstool, with a substantially crossed or X-shaped structure, and sometimes foldable for the support of the seat, the fully folding Tripolina chair and historically used in battlefields, the monobloc chair generally made of polymeric material and used for outdoor environments, mainly in the field of catering, the rocking chair comprising two curved supports designed to allow the rocking movement typical of the chair in question, and the cantilever chair, or cantilever, of very common use and comprising only two uprights folded at the level of the floor and seating level and connected horizontally by a continuous tube.

To the aforementioned examples, numerous other different types and structures of chairs have been added designed to satisfy aesthetic needs, for example the market demand for a certain shape, or technical needs, deriving for example from the need to optimize the production process while maintaining high quality levels of the chair product.

In particular, some examples of chairs are substantially constituted by a frame used to give support and shape to the overall structure of the chair and at least one membrane, typically made of fabric, capable of being tied to the frame in such a way as to create a seat and, possibly, back.

Examples of chairs which include such composition systems are described in the patent documents U.S. Pat. Nos. 2,830,350A, 2,830,350A and 3,752,209A.

Document U.S. Pat. No. 2,830,350A substantially describes a coupling mechanism between frame and fabric which provides for the use of a sheath defining an open profile which can be placed on the frame in such a way as to lock onto it in position, thanks to a flap which fits into a slot, and in such a way as to trap one end of the fabric within a substantially hook-like portion.

The document U.S. Pat. No. 2,830,350A basically presents the same principle described above, but in an even more simplified way since the sheath is a simple tubular element counter-shaped entirely to the frame.

Finally, document U.S. Pat. No. 3,752,209A describes an evolved version of the sheath of the previous document in which serrated elements are implemented at the ends of the profile to increase the grip of the sheath on the frame and on the fabric.

The known art described includes some important drawbacks.

In particular, assuming that the evolution of the support membranes has made it possible to create more performing seats and backrests thanks above all to the use of fabrics whose mechanical behaviour is variable in a localized and predetermined way, depending on its internal conformation, the mechanisms of simple and rapid constraints, such as those described in the aforementioned patent documents, substantially nullify or reduce the performances of new generation fabrics.

In fact, it is difficult for the fabric to be effectively constrained homogeneously along the frame, and furthermore, during normal use, the sheaths of the known art involve releases of fabric, in some points particularly stressed by tensile stresses, which compromise the overall functionality of the chair.

In this context, the chair is uncomfortable or even can cause the user to adopt incorrect postures that compromise the body balance.

In conclusion, the effects of wear on the sheaths that support the tensile stressed fabric can lead to actual breakage of the chair with the need to replace the components and, in the worst cases, breakage even of the fabric which remains only partially trapped in part of the sheath. In this situation, the technical task underlying the present invention is to devise a modular chair and method of manufacturing said modular chair capable of substantially obviating at least part of the aforementioned drawbacks.

Within the scope of said technical task, an important aim of the invention is to obtain a modular chair and relative manufacturing method that allow to make the most of the new generation fabrics with variable localized behaviour in a highly performing way and without reducing, therefore, or frustrating the effectiveness of such fabrics. Another important object of the invention is to realize a modular chair and related manufacturing method that allow to constrain the membrane determined by the fabric in a homogeneous way with respect to the frame in such a way as not to alter the behaviour of the membrane, especially when designed specifically for use on the frame.

A further task of the invention is to provide a chair which remains, over time, always comfortable and facilitates the adoption of a correct posture by a user.

In conclusion, an object of the invention is to provide a chair that is extremely long-lasting, that is, less sensitive to the effects of wear, allowing reduced replacements and, at the same time, a high simplicity and cost-effectiveness of manufacture.

The technical task and the specified aims are achieved by a modular chair, and related manufacturing method, as claimed in the annexed claim 1.

Preferred technical solutions are highlighted in the dependent claims.

Figure 2:
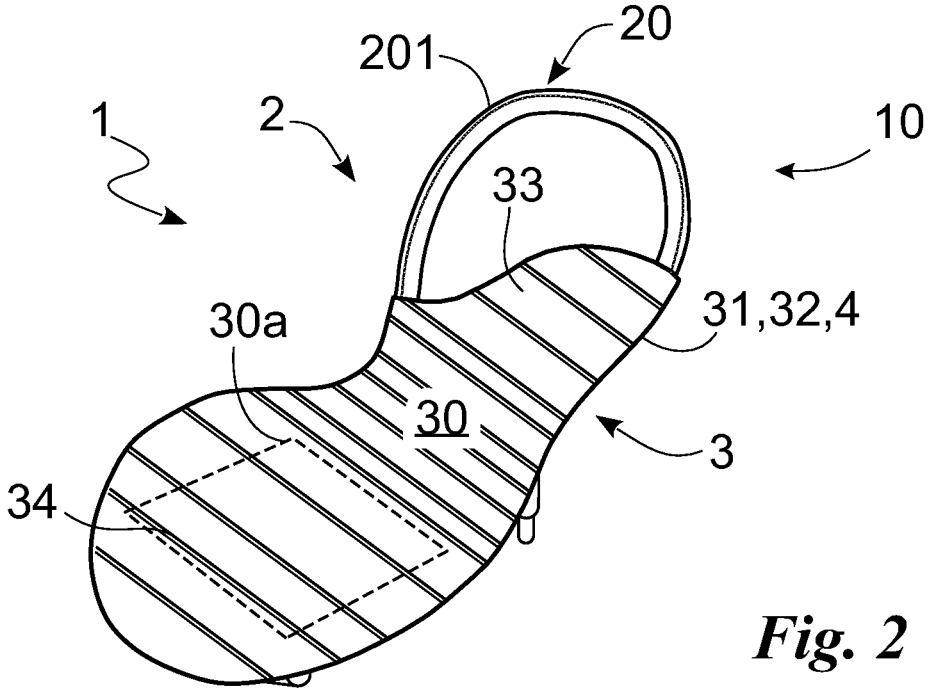
Figure 3:
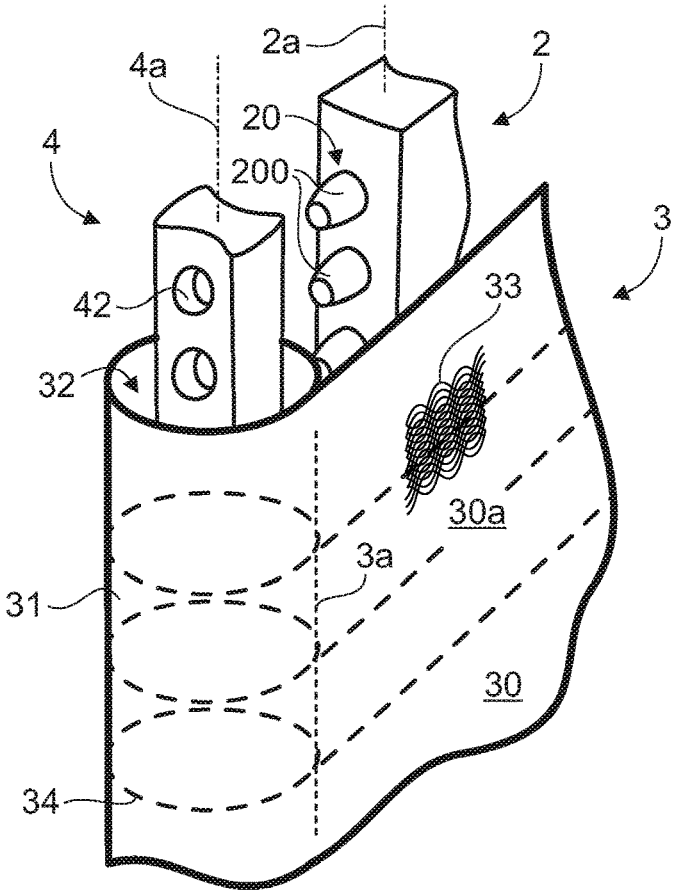
Figure 4A:
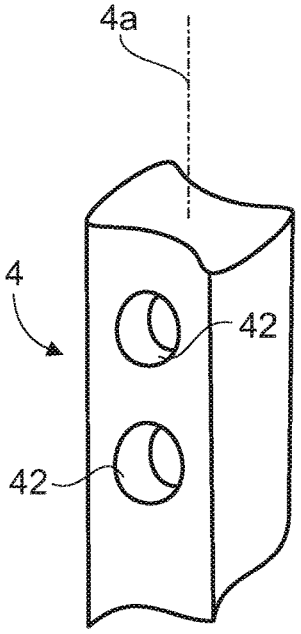
Figure 4B:
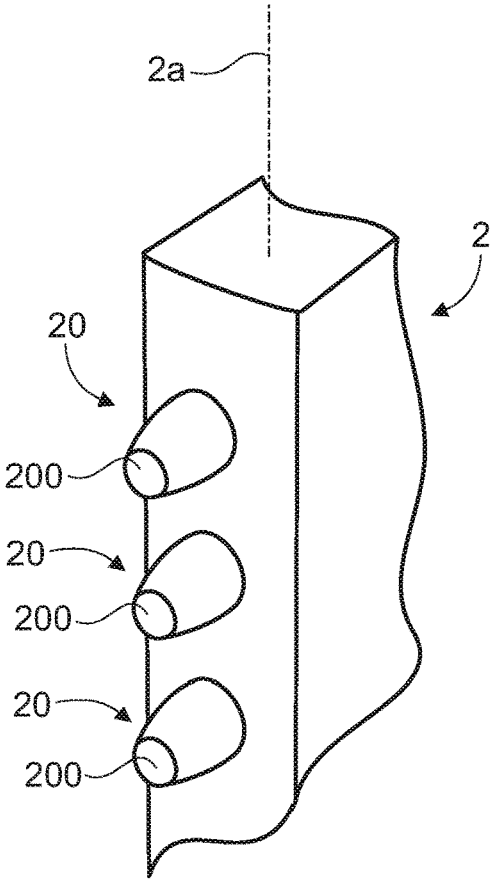
Figure 5A:
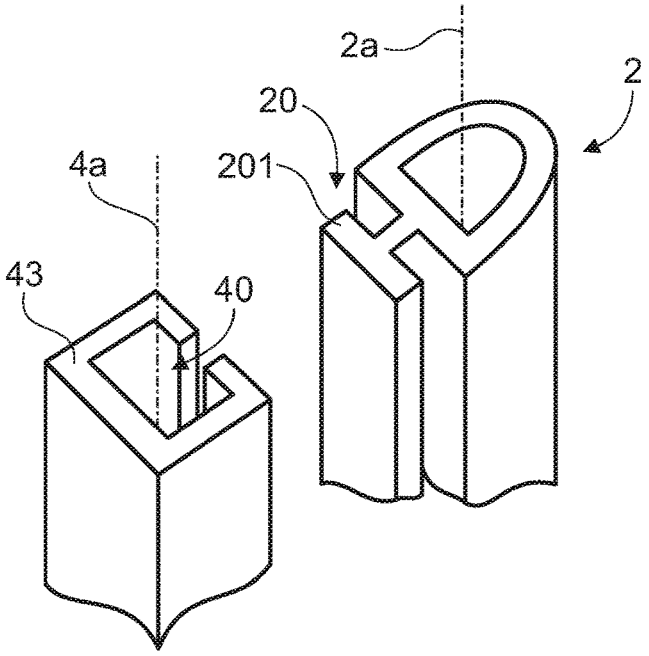
Figure 6:
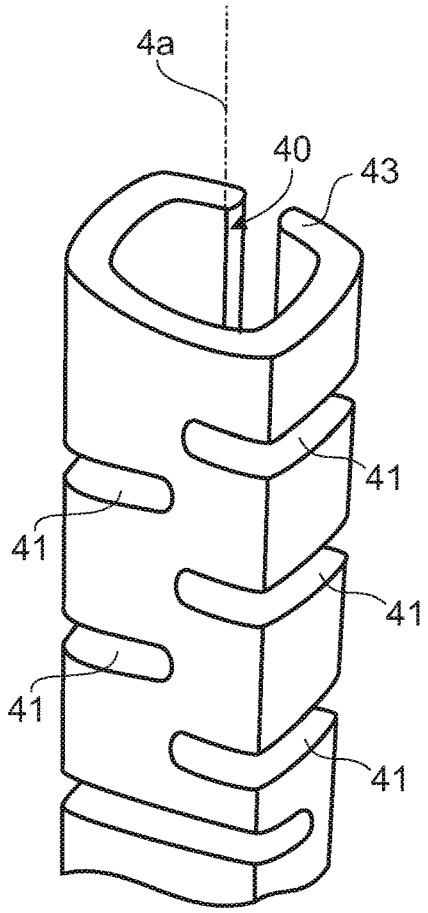
Figure 5B:
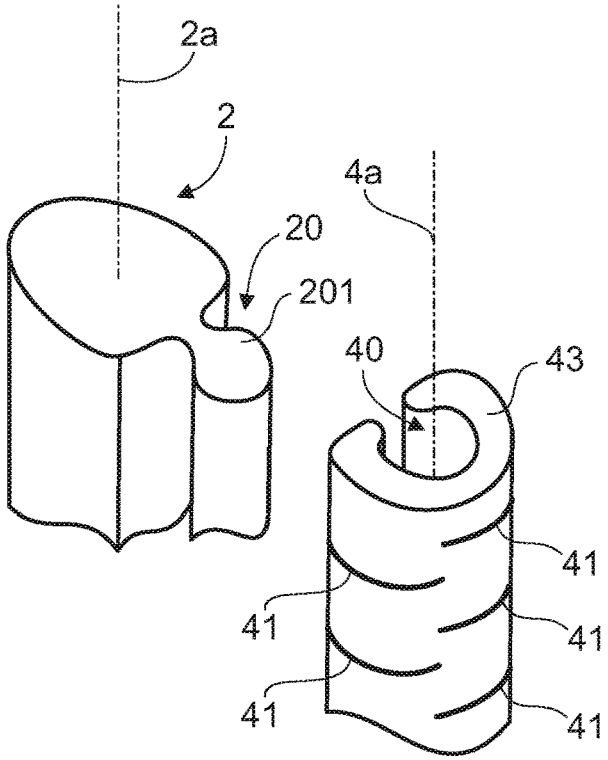
Figure 7:
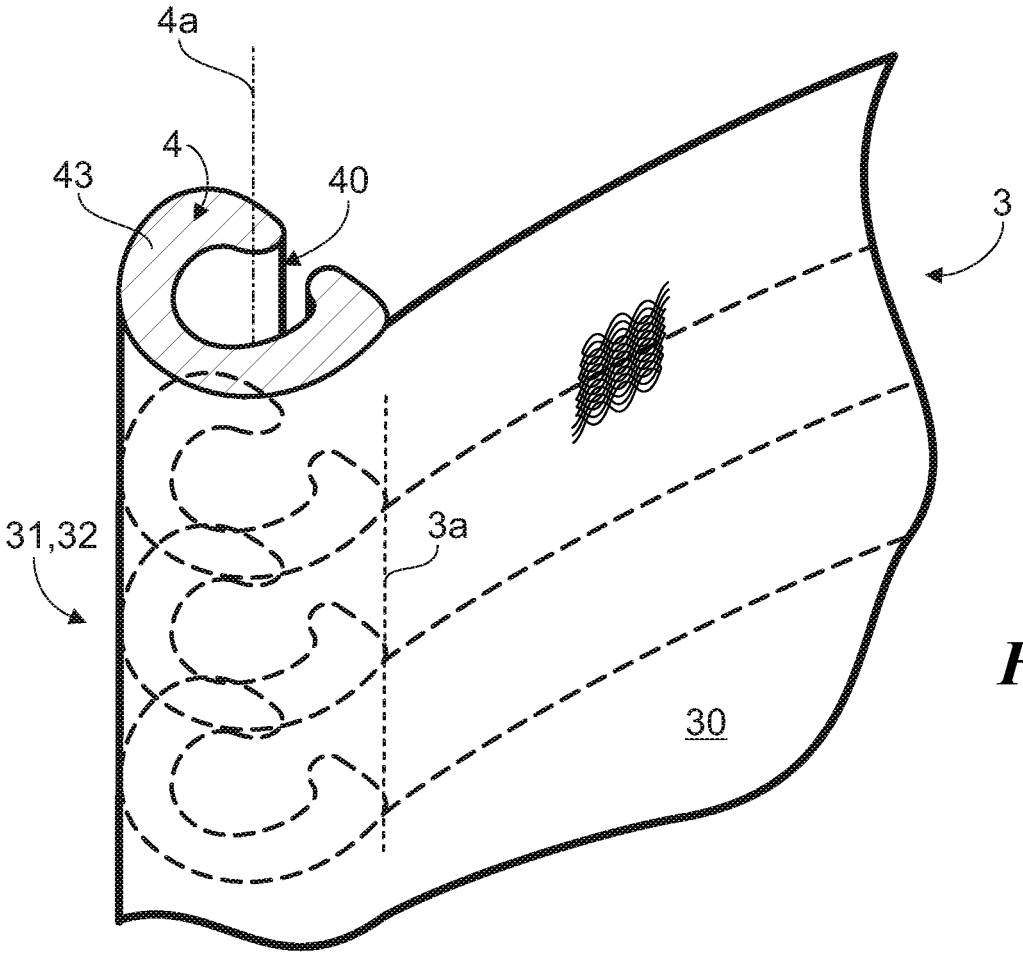
Figure 8:
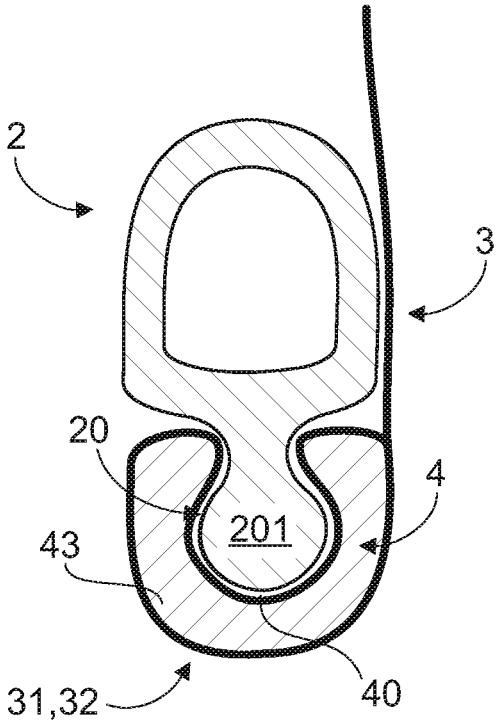
Figure 9A:
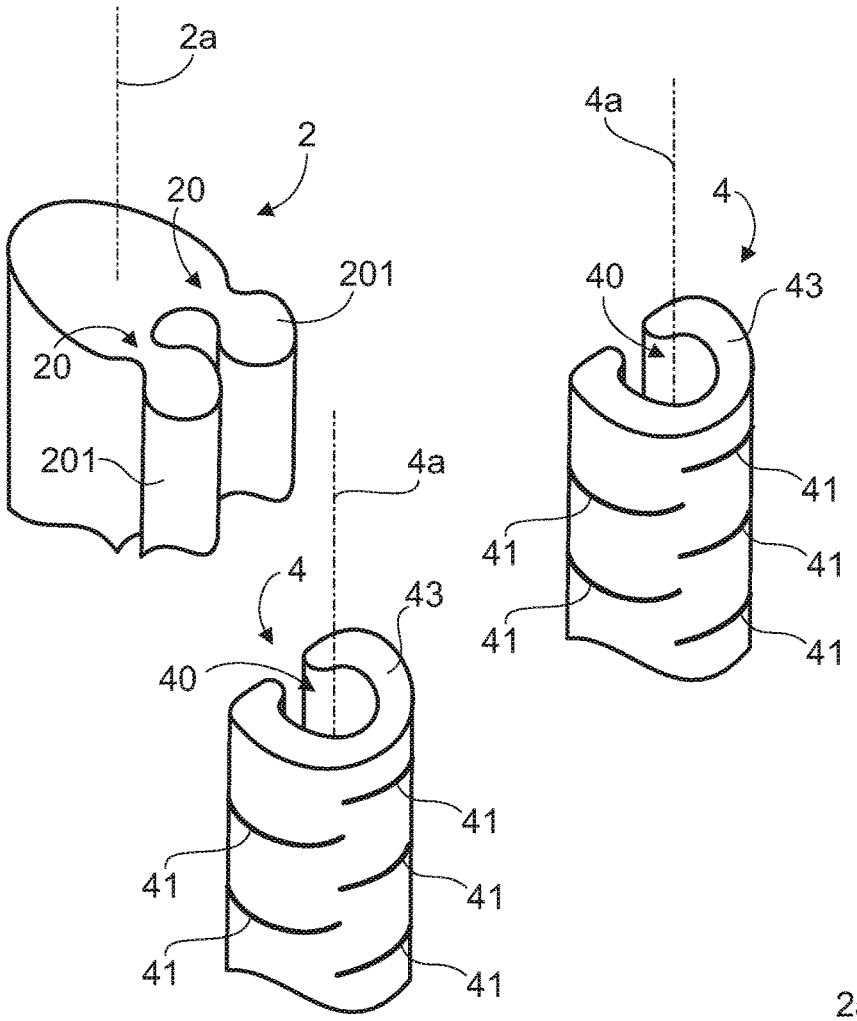
Figure 9B:
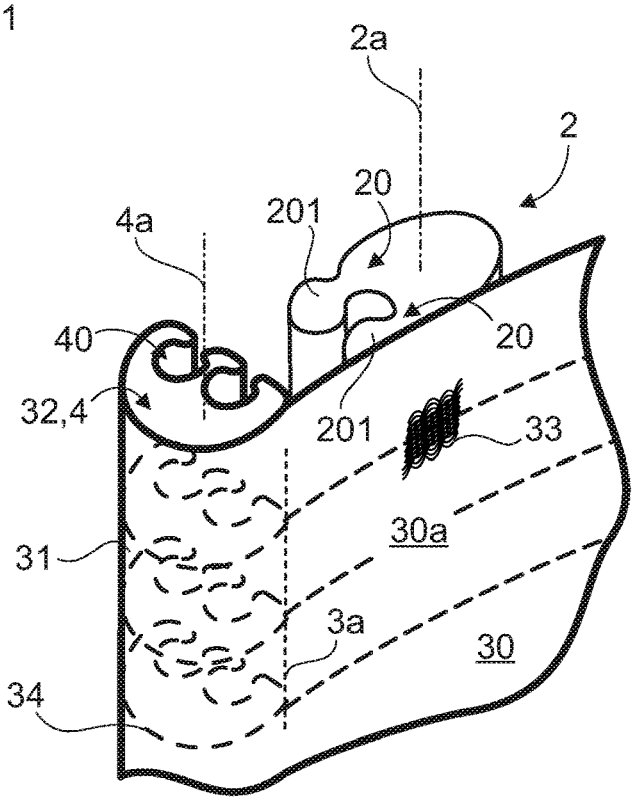
Figure 10:
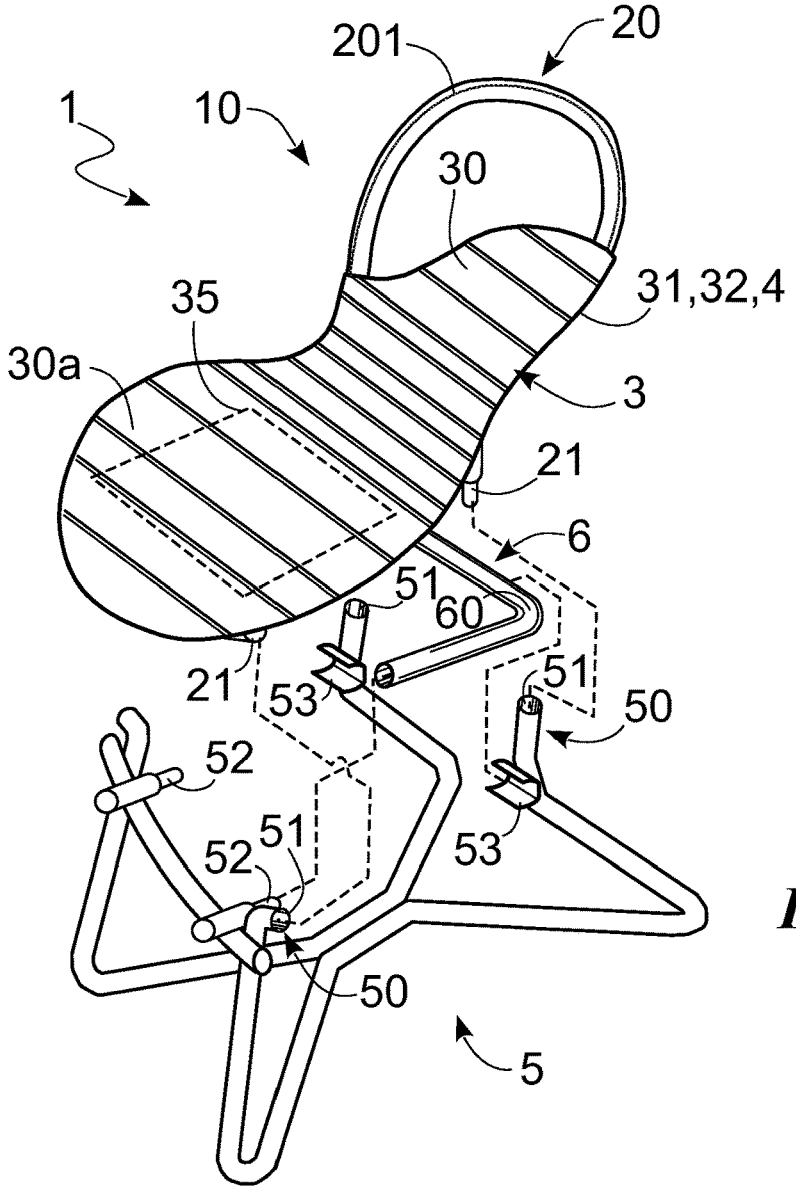
Figure 11:
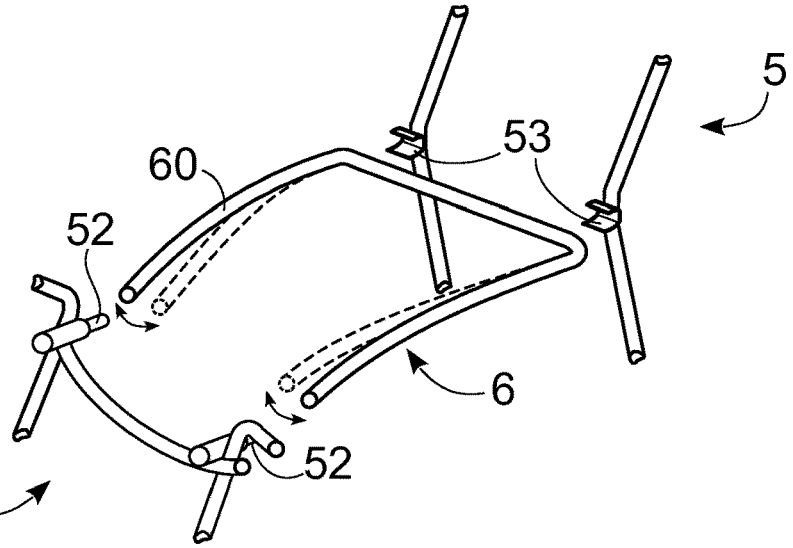
Figure 12:
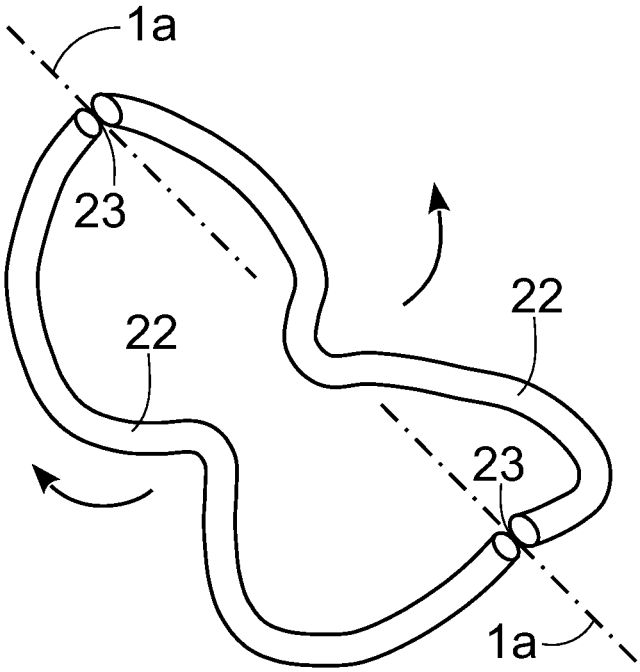
Figure 13A:
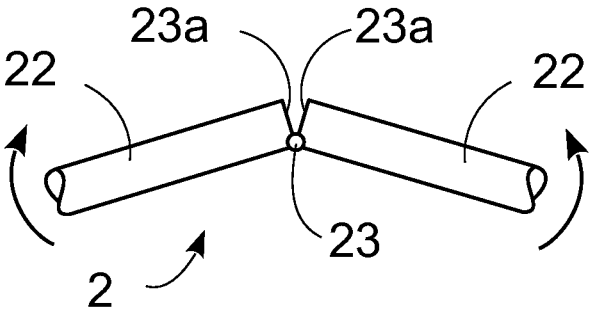
Figure 13B:
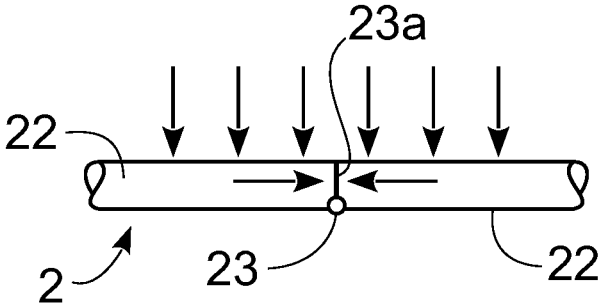
Figure 14:
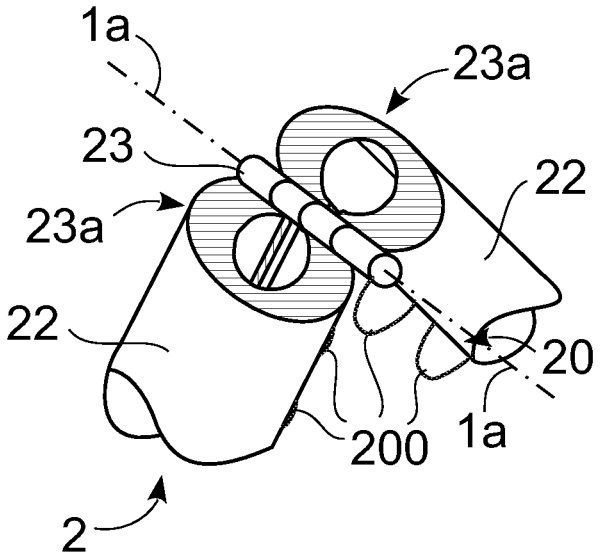
Figure 15:
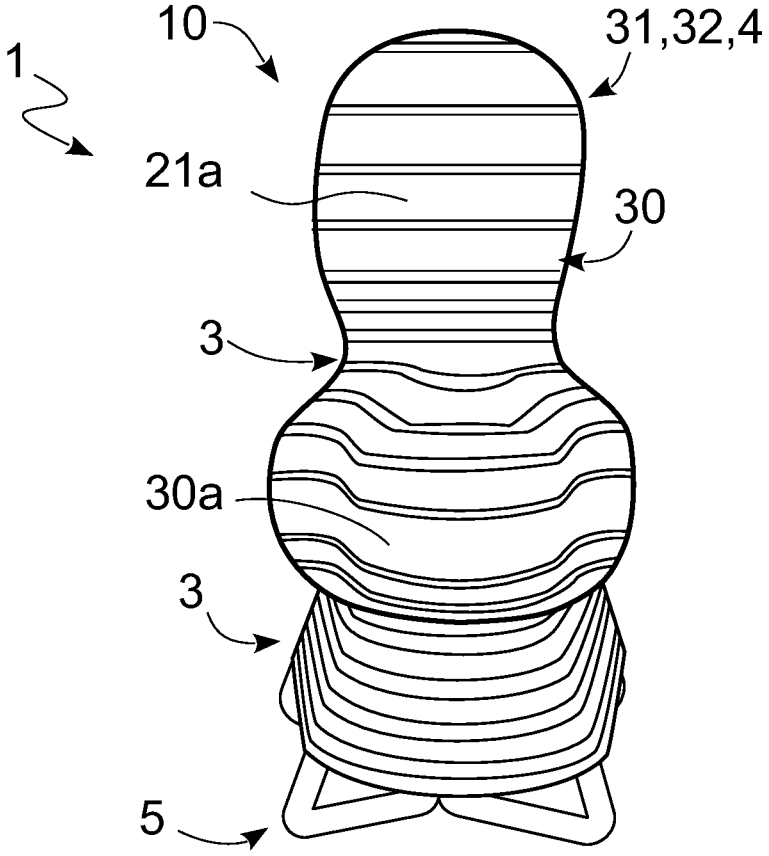
Figure 16:
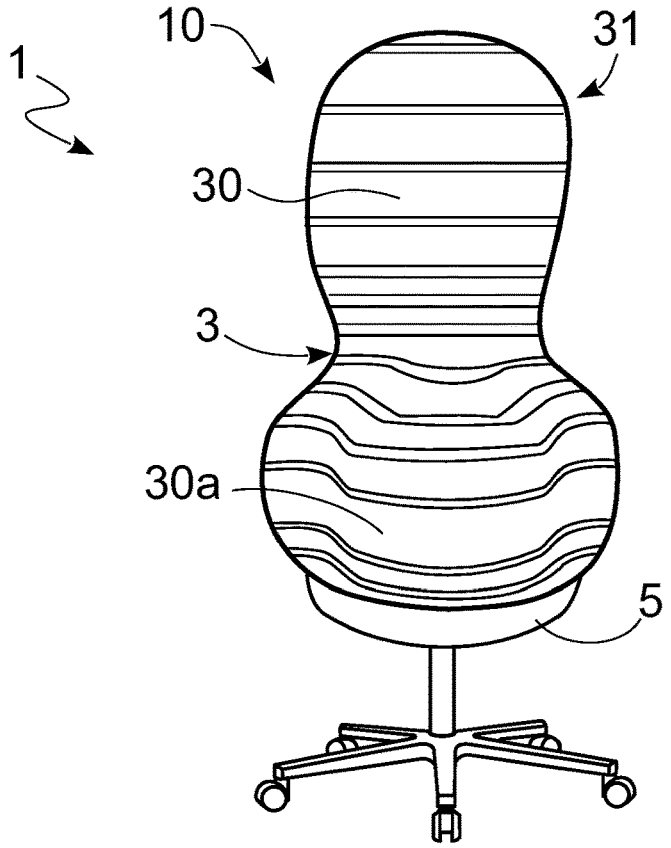
Figure 17:
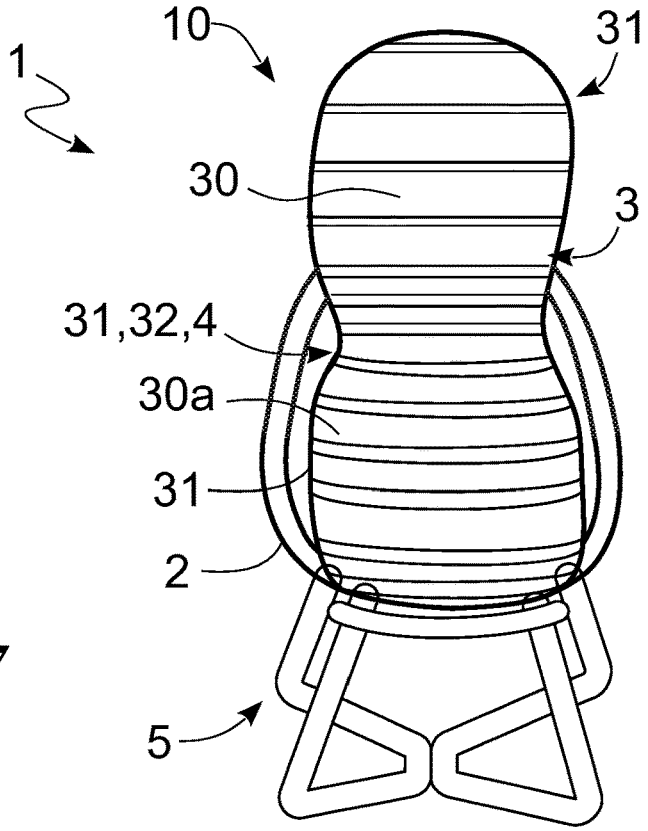

The characteristics and advantages of the invention are clarified below by the detailed description of preferred embodiments of the invention, with reference to the accompanying figures, in which:

the FIG. 1 shows an example of modular chair according to the invention realized with a complex, three-dimensional frame;

the FIG. 2 shows a partially sectioned view of the chair of FIG. 1;

the FIG. 3 is an example of a coupling mechanism of a modular chair according to the invention in a first configuration wherein the frame includes the teeth and the cursor is a rod including counter-shaped holes to the teeth;

the FIG. 4*a* shows the slider of FIG. 3 mechanism;

the FIG. 4*b* shows the frame of FIG. 3 mechanism;

the FIG. 5*a* illustrates another example of a coupling mechanism of a modular chair according to the invention in a first configuration wherein the frame comprises a T-shaped rail and the cursor is a tubular element counter-shaped to the rail;

the FIG. 5*b* is a further example of a coupling mechanism of a modular chair according to the invention in a first configuration wherein the frame comprises an O-shaped rail and the slider is a tubular element counter-shaped to the rail;

the FIG. 6 shows a slider similar to the slider of FIG. 5*a* wherein the notches are shown and in which, in particular, there is a wider notch in the bottom to allow the fold of the slider even up to angles equal to or greater than 90°;

the FIG. 7 shows an example of a part of the coupling mechanism of a modular chair according to the invention in a second configuration wherein the slider is a tubular element integrated in the membrane;

the FIG. 8 illustrates a top view of a coupling mechanism of a modular chair according to the invention which includes a frame comprising a rail and the slider and the FIG. 7 membrane;

the FIG. 9*a* is an example of a coupling mechanism of a modular chair according to the invention wherein the frame comprises two rows of O-shaped rails and two separate sliders each including a tubular element contour-shaped to the rail;

the FIG. 9*b* is a variant of the example of FIG. 9*a* wherein the protuberances are configured to be engaged by a single slider comprising two receiving portions;

the FIG. 10 shows an example of embodiment of a modular chair according to the invention wherein there are of special support means;

the FIG. 11 illustrates a detail of the support means and, in particular, of the tensioner coupling mechanism of a modular chair according to the invention;

the FIG. 12 is a schematic perspective view of a preferred example of a frame of a chair according to the invention;

the FIG. 13*a* represents the detail of the mechanism carried by the frame hinge of a modular chair according to the invention in the inactive configuration or pre-assembly;

the FIG. 13*b* shows the detail of the mechanism realized by the hinge of the frame of a chair according to the invention in the configuration of use or assembled;

the FIG. 14 illustrates the detail of the hinge of a modular chair according to the invention;

the FIG. 15 is a front view of a modular chair according to the invention including a bottom of the covering membrane of the support structure and, in particular, of the support means;

the FIG. 16 is a front view of a modular chair according to the invention including a coupling device on the bottom of the frame and the support means in an office embodiment; and the FIG. 17 shows a front view of a modular chair according to the invention in an alternative embodiment wherein the membrane is suspended.

In the present document, the measurements, values, shapes and geometric references (such as perpendicularity and parallelism), when associated with words like "about" or other similar terms such as "approximately" or "substantially", are to be considered as except for measurement errors or inaccuracies due to production and/or manufacturing errors, and, above all, except for a slight divergence from the value, measurements, shape, or geometric reference with which it is associated. For instance, these terms, if associated with a value, preferably indicate a divergence of not more than 10% of the value.

Moreover, when used, terms such as "first", "second", "higher", "lower", "main" and "secondary" do not necessarily identify an order, a priority of relationship or a relative position, but can simply be used to clearly distinguish between their different components.

Unless otherwise specified, as results in the following discussions, terms such as "treatment", "computing", "determination", "calculation", or similar, refer to the action and/or processes of a computer or similar electronic calculation device that manipulates and/or transforms data represented as physical, such as electronic quantities of registers of a computer system and/or memories in, other data similarly represented as physical quantities within computer systems, registers or other storage, transmission or information displaying devices.

The measurements and data reported in this text are to be considered, unless otherwise indicated, as performed in the International Standard Atmosphere ICAO (ISO 2533:1975).

With reference to the Figures, the modular chair according to the invention is globally indicated with the number 1.

The modular chair 1 is preferably a chair, however it could be any device that allows the seat of a user and that can, depending on the configuration, therefore also consist of devices other than a chair such as an armchair, a sofa.

For example, the chair 1 can also be a seat for a vehicle or for other means such as trains or aircraft.

Furthermore, the chair 1 is not constrained to a specific use and design, but can be adapted, depending on convenience, to uses of various kinds such as home use, in the office or in other environments other than those mentioned.

For example, chair 1 can be a chair that incorporates joints, such as common task chairs. Alternatively, the chair 1 can be, as already mentioned, used for applications in the industrial field, in particular on machines, airplanes, as well as applications in the medical field, in particular as wheelchairs, or even in the field of children's chairs. In particular, the modular chair 1 preferably comprises at least one support structure 10.

The support structure 10 is preferably adapted to allow the support of the chair 1 and, in particular, to support a user resting on the chair 1.

Therefore, it is substantially the part of the chair 1 adapted to accommodate the various components that allow the correct operation of the chair 1.

The support structure 10 can therefore comprise support means 5.

The supporting means 5 can be, for example, legs or stems, configured to support the resting portion on which the user rests. Alternatively, the support means 5 can be configured in a particular way as described below.

In any case, preferably, the support structure 10 includes a frame 2.

The frame 2 is substantially the part of the support structure adapted to interface with the support portion on which the user rests directly.

The frame 2 can therefore be made by means of one or more elements. These elements can be connected and create a continuous structure, or they can be fragmented and discontinuous.

Among the various configurations, preferably but not necessarily, the frame 2 defines, in use or, in other words when assembled, a closed structure.

Preferably, the frame 2 extends, in whole or in part, along an expansion trajectory 2*a*.

This expansion trajectory is the direction along which the frame 2 or the part of the frame 2 extends. The expansion trajectory 2*a* can, therefore, be rectilinear or it can also be curvilinear.

If the frame 2 defines a closed structure, for example a sort of frame, the curvilinear expansion path 2*a* allows the frame 2 to close itself and trap a hole, as happens for every ring.

Of course, the frame 2 could also comprise additional components, such as the armrests, or supports, which are substantially removable and develop outside the expansion path 2*a*.

The frame 2 can therefore be of the traditional or conventional type. Or, it may not necessarily have a structure formed by planar portions.

Preferably, the frame 2 determines a structure whose path is complex curvilinear which extends into space in a three-dimensional manner.

A complex structure of this type is, for example, a composite 3D curve or a curve that can be made from an expansion trajectory 2*a* which rotates around at least two main axes in three-dimensional space.

The frame 2 could, therefore, be made of polymeric material, for example extruded, or other materials which allow to produce hollow and continuous profiles with an expansion trajectory 2*a* that is not coplanar.

Alternatively, the frame 2 could be made by means of a composite structure, for example including a metal core covered with a different material, such as a polymeric material, for example by means of technologies such as injection moulding of polymer on a metal core, or even without a core in metal.

Non-coplanarity however remains an unnecessary but preferable element for the purposes of making the chair 1, above all in reference to the comfort offered by it.

The frame 2 can in turn be constrained and supported by other components, such as supporting means 5 such as legs or joints, which support the frame 2 with respect to the ground.

The frame 2 therefore includes at least a protuberance 20.

The protuberance 20 is substantially a part of the frame 2 which is distinguished from the rest of the frame 2 to define a function as better specified hereinafter.

Said protuberance 20, essentially, preferably protrudes in an incident direction with respect to the expansion trajectory 2*a*.

Even more in detail, the protuberance 20 extends perpendicularly to the expansion trajectory 2*a*.

The protuberance 20 can, therefore, realize a plurality of different configurations.

In a first embodiment, for example, the protuberance 20 includes at least one tooth 200. Said tooth 200 therefore extends perpendicularly with respect to the expansion trajectory 2*a*.

Of course, preferably, the frame 2 includes a plurality of protuberances 20 when they are defined by teeth 200. Therefore, such protuberances 20 are distributed discontinuously along the development path 2*a* on the frame 2.

In an alternative embodiment, the protuberance 20 includes a rail 201.

The rail 201 preferably extends continuously parallel to the expansion trajectory 2*a*. The rail 201 can, therefore, in turn be configured in different ways.

For example, it can realize a section area, along a plane perpendicular to the expansion trajectory 2*a*, substantially having a T shape.

Or, the rail 201 can define a section area having a substantially rounded or O shape. Furthermore, the frame 2 could comprise a plurality of protuberances 20, for example arranged in rows parallel to each other and extending parallel to the expansion path 2*a*.

Of course, the protrusions 20 could include rows of teeth 200 or rails 201, as shown for example in FIGS. 9*a*-9*b*.

As anticipated, the frame 2 has the purpose of supporting the support portion which comes into direct contact with the user.

This support portion is made, in particular, by a membrane 3.

Therefore, the chair 1 also comprises a membrane 3.

The membrane 3 is therefore configured to be substantially constrained, in whole or in part, to the entire frame 2 or to part of it.

The membrane 3, in general, is substantially a deformable sheet which can be made of any material.

Preferably, the membrane 3 is made with a fabric that can be defined exclusively by a sheet of fibres, or it can also comprise padding elements, for example trapped between two flaps of fabric in such a way as to define a sandwich structure.

Preferably, in any case, the membrane 3 defines a resting surface 30 and an edge 31.

The resting surface 30 is preferably, in use, adapted to support the user. Therefore, preferably, it defines the support portion for the user himself and is capable of supporting the weight force of the user.

The edge 31, on the other hand, is substantially defined by the perimetric zone of the support surface 30. In other words, the edge 31 is substantially defined by at least part of the contour area of the support surface 30.

In use, preferably, the frame 2 is able to support, possibly in tension, the membrane 3 in correspondence with at least part of the edge 31.

The membrane 3 can, in fact, be entirely connected to the frame 2 along its edge 31 or it can be connected only partially along its edge 31 to example in the case in which it is intended to define a chair 1 including part of the membrane 3 suspended in the vacuum.

This last detail may also be suitable if the chair 1 is to be made with different membranes. In fact, the chair 1 could comprise membranes 3 partly constrained to the frame 2 in the edges 31 and partly constrained to other rigid or deformable elements to form the resting portion.

In particular, the frame 2 preferably tends the membrane 3 locally in relation to the shape assumed by the frame 2 itself. In this sense it is therefore important that the membrane 3 follows, at least in correspondence with the edges 31, the expansion trajectory 2*a*.

Furthermore, the membrane 3, when comprising a fabric, can include composite fibres, or rather comprising polymeric filaments around which some fabric filaments are twisted. This type of fibre allows to reinforce the fabric or, more generally, to modify the local mechanical properties of the membrane 3 itself as desired. By local properties it is meant that the bearing surface 30 can be considered as a set of smaller surfaces defining each of its own mechanical properties and which can therefore be variable from surface to surface.

Basically, the conformation of the membrane 3, especially if in fabric, can be achieved with studies and procedures such as, for example, the theory of finite elements or other types of methods that allow to discretize the surface and control the local mechanical properties of the discrete elements.

The membrane 3 can be made using automated knitting machines and, in particular, with machines known as flat bed knitting machines.

With these machines it is possible, as already mentioned, to control the mechanical properties of the discrete elements of the support surface 30 in such a way as to allow the membrane 3 to assume the desired characteristics according to the structural elements interacting with it in the chair 1.

The membrane 3, could also be made with conventional weaving machines.

In this case, for example, the fabric of the membrane 3 can exhibit different mechanical properties inside the supporting surface 30, for example depending on the titration or the weft adopted inside the fabric.

Furthermore, the membrane 3 can, whether made with computerized technology or made with conventional textile technology, include localized support elements. For example, the membrane 3 can include inside its own metal structures, such as bars or filaments, trapped or woven inside pockets that can be easily obtained in the membrane 3, in such a way as to locally increase the stiffness of the supporting surface 30. In sense, the fabric of the membrane 3 could appear as a woven support surface 30 including ribs or diaphragms, for example metallic, suitable for reinforcing the structure of the fabric itself, or also metallic or non-configured filaments to be heated on command to locally modifying the thermal properties of the membrane 3. In the preferred embodiment, the membrane 3 is made by combining two different intertwining methods. Preferably, in fact, it is realized by combining the knitting technique with the woven technique.

In detail, the membrane 3 includes a periodic weave the base of which comprises at least one main filament 33.

The main filament is preferably woven to mesh.

Furthermore, the resting surface 30 comprises one or more portions with controlled behaviour 30*a*.

The portions with controlled behaviour 30*a* preferably include the periodic interlacement, determined by the main filament 33, inside which at least one secondary filament 34 is further inserted.

The secondary filament 34 is preferably arranged in the weft along a predetermined trajectory in such a way as to vary, in a controlled manner, the mechanical behaviour of the resting surface 30.

The mechanical behaviour of the support surface 30 is substantially varied at the portions a controlled behaviour 30*a*, which are areas of the support surface 30 which include secondary filaments 34 woven, varying the type or number of secondary filaments 34.

Substantially, therefore, the membrane 3 preferably includes a hybrid fabric including a mesh structure to which the secondary filaments 34 in suitable portions with controlled behaviour 30*a* are inserted in the weft with the technique of woven stitching combined with the knitting technique. These secondary filaments 34 are preferably inserted inside the mesh in such a way as to be woven at least between two adjacent rows of main filament 33 along a predetermined trajectory. As is known, in fact, the periodic weaves that make up a mesh can be substantially defined by continuous rows mutually intertwined in succession comprising at least one main filament 33 which has preferably, but not necessarily, properties and characteristics different from the secondary filament 34.

However, the insertion of the secondary filament 34 can be carried out by means of a principle other than interlacing. For example, the main filament 33 can be worked in such a way as to make a double layer. Therefore, the secondary filament 34, in this situation, can be intertwined, for example in an alternative way, to the two layers of knitting, or the secondary weft filament 34 can be not woven into the mesh but simply inserted between the layers when the mesh has two front and back layers.

Configurations of this type can facilitate the insertion of cushions or even air bags between the layers of the membrane 3.

Substantially, therefore, in general, the membrane 3 includes at least one main filament 33 defining a knitted weave inside which is inserted, according to embodiments which may be different, at least one secondary filament 34 arranged in the weft, or rather along a predetermined trajectory.

From a microscopic point of view, the adjacent rows of main filament 33 of the mesh define loops substantially arranged along a direction called the stop. The latter preferably defines the predetermined trajectory of the secondary filament 34. Preferably, the secondary weft filament 34 is arranged adjacent to the loops and passes between the weave defined by the main filament 33 and the stop.

In detail, the secondary filament 34 can preferably be intertwined with two adjacent rows of the main filament 33 and the adjacent rows of the main filament 33 can therefore define meshes of the weave through which the secondary filament 34 passes.

In particular, the secondary filament 34 therefore, it is preferably intertwined with the main filament 33 in such a way as to pass on the front and on the back of the mesh, from loop to loop or every two loops. In general, the secondary filament 34 is preferably woven with the main filament 33 along the line, but could also be intertwined with the main filament 33 along other directions.

Naturally, the weave could include a plurality of secondary filaments 34 for example along the same line direction or alternatively also along a direction perpendicular to the line direction, since, as already said, the secondary filament 34 arranged in the weft allows to vary the local mechanical behaviour of each individual portion with controlled behaviour 30*a* by varying the type, or even the number, of secondary filaments 34.

Basically, this configuration of the membrane 3 fabric allows to realize membranes 3 with uneven behaviour along the entire surface of support 30 for example by creating more rigid areas, for example intended for the user's seat, or less rigid, for example intended for the user's back, simply by checking the type or number of secondary filaments 34 woven.

From a practical point of view, in order to obtain the insertion of the weft in the knitted mesh, processes can be provided that involve the weaving of the main filament 33 around the secondary filament 34 while continuing to modify, alternately, the positions of the back and front needle, or rather corresponding respectively to the face of the obverse and the face of the reverse, on the knitting machine. In this way, the main filament 33 forms meshes which are substantially wrapped around the secondary filament 34 so as to block it.

In detail, moreover, the secondary filament 34 can be inserted inside the weave of the mesh defined by the main filament 33 even simultaneously with the processing of the needles, by means of a thread guide. The thread guide, per se known to those skilled in the art, can therefore position the secondary filament 34 inside the weave, while the latter is being formed.

The yarn guide can also be configured to position a plurality of secondary filaments 34 in the weave, as already extensively described.

As already mentioned, the secondary filament 34 could also be substantially woven between two layers of mesh. Therefore, the secondary filament 34 could be incorporated between two layers each defining a weave whose base is defined by the main filament 33. Furthermore, the secondary filament 33 could be woven, for example alternately, to the two layers, or it could be inserted between two layers defining a substantially sandwich structure. Indeed, the mesh weave of the main filament 33 could define a plurality of tubular portions within which one or more secondary filaments 34 are inserted.

Preferably, the secondary filament 34 defines mechanical characteristics different from the main filament 33. For example, the secondary filament 34 can be more or less rigid with respect to the main filament 33 in such a way as to increase the elasticity or the local stiffness of the membrane 3 in correspondence with the portions with controlled behaviour 30*a*.

It is important to note, in this sense, that the membrane 3, in particular the entire bearing surface 30, can include a plurality of mutually different portions with controlled behaviour 30*a*. Therefore, each of the controlled behaviour portions 30*a* can be different from the others and can include a different number of secondary filaments 34 and/or also secondary filaments 34 simply of different types. Therefore, the membrane 3 can include, internally, various different secondary filaments 34. Furthermore, the secondary filament 34 could also define variable and different thermal or electrical properties with respect to the main filament 33. In this sense, for example, the secondary filament 34 could also be a filament with mechanical properties similar to the main filament 33, but more or differently reactive to heat, rather than to the passage of current. For example, the secondary filament 34 could include piezoelectric material capable of varying the shape following the passage of current inside it or also a material that allows the secondary filament 34 to undergo elongation or shrinkage in proportion to the application and subtraction of heat. Therefore, the membrane 3 can include at least one secondary filament 34 which comprises, or consists of, at least one component of the thermo-shrink or heat-shrink type, in such a way as to be able to vary the local voltage of the portions with controlled behaviour 30*a* in a function of the heat to which the membrane 3 is subjected.

Or, as previously anticipated, the secondary filament 34 could include material capable of being thermally controlled in such a way as to allow, for example, the local temperature of the controlled behaviour portion to vary on command 30*a*.

The secondary filament 34 can also comprise at least a thermo-shrinking component and an elastic component so as to be able to obtain a shrinkage controlled by both the heat and the elastic component.

In any case, preferably, the secondary filament 34 and the main filament 33 are mutually integrally constrained at the edge 31 of the membrane 3. By integrally constrained, it is meant that, while the secondary filament 34 and the main filament 33 are mutually sliding in the areas of intertwining or overlapping defined in the portion with controlled behaviour 30*a*, at the edge 31 they are linked together in such a way as not to be mutually labile with respect to each other. This constraint can be obtained by sewing or gluing or thermally welding the filaments 33, 34 at fixed points arranged in the edge 31, or also by other methods, for example by the methods described below.

This last characteristic substantially allows to increase the working efficiency of the weft in the mesh. Furthermore, the effectiveness is further improved thanks to a configuration as described below.

The membrane 3, in fact, also includes a guide 32.

The guide 32 is preferably a tubular element arranged in correspondence with the edge 31. This guide 32 can be an external element welded or sewn onto the edge 31 of the membrane 3, or it can be made by the membrane 3.

The guide 32 can therefore be defined by a winding of the membrane 3 in correspondence with the membrane 3.

In the preferred embodiment of the membrane 3, moreover, the coupling of a secondary filament 34 woven into one or more layers of mesh defined by the periodic weave whose base is defined by main filament 33, occurs mainly at the guide 32.

In detail, the secondary filament 34 defines at least one winding within the guide 32 in such a way as to form a row or row 3*a*.

The row 3*a* is substantially defined by the closure of the windings and includes the fixed points along which the filaments 33, 34 are constrained integrally between them.

The row 3*a* extends, therefore parallel to the guide 32, and defines a line in correspondence with which the main filament 33 and the secondary filament 34 are mutually locked and integral with each other.

Even more in detail, the secondary filament 34 is inserted inside the membrane 3 in such a way as to make at least one almost complete revolution within the guide 32. In particular, moreover, the secondary filament 34 can be completely wrapped in the guide 32, or partially, substantially defining wefts with double secondary filament 34 given, for example, by the entry of the secondary filament 34 into the guide 32 and by the subsequent exit.

The winding of the secondary filament 34 has the very important effect of mutually locking the main filament 33 and the secondary filament 34 in correspondence with the row 3*a* parallel to the guide 32.

The arrangement of the secondary filament 34 in the weft can also follow a plurality of paths.

For example, the secondary filament 34 can be disposed within the knitted base weave following a continuous path.

The path can be achieved by arranging the secondary filament 34 in such a way as to wind itself, with a complete turn, within the guide 32, to then proceed within the knitted weave defined by the main filament 33, and wind again within a second guide 32, or another portion of the same guide 32, arranged on the opposite side with respect to the previous side of the guide 32. In order to pass to a row, or line, lower or upper, the secondary filament 34 proceeds parallel to the guide 32 and then winds again on and woven again with the main filament 33 until it reaches the starting guide 32. Of course, this process can provide, along some lines, the introduction of a second secondary filament 34 or also of a third or more secondary filament 34.

Even more in detail, the secondary filament 34 is woven within the weaving at the guide 32 in such a way as to be "hooked in English" or "false English rib" as usually occurs between the filament and the needle of knitting.

Furthermore, the secondary filament 34 can be dragged next to the guide 32, to pass from one stop to the other, or it can be inserted inside the guide 32 itself.

In general, preferably, the secondary filament 34 is rigidly constrained to the woven made by the main filament 33 at the guide 32; otherwise the secondary filament 34 slides freely inside the weave in the areas of the membrane 3 different from the edges 31, or rather from the guide 32.

The guide 32 has, in any case, another important function.

The guide 32 is, in fact, configured to house at least one slider 4.

The chair 1 therefore also comprises at least one slider 4. The mechanism for attaching the chair 1 could, in particular, include exclusively one or more sliders 4, a membrane 3 and a frame 2. In this sense it is intended that, preferably but not necessarily, the mechanism does not require additional components for the realization of the constraint between the parts.

If there are several sliders 4, as shown in FIG. 9*a*, they can be constrained to the same frame 2 on parallel rows.

The slider 4 is preferably a long-form element that can be inserted inside part of the membrane 3 at the edge 31, in detail thanks to the guide 32.

By way of example only, the slider 4 could also be a sliding bar, or a rod slider or any other sliding element available in the guide 32.

The slider 4 therefore defines an extension direction 4*a*.

The extension direction 4*a* is the direction along which the cursor mainly extends. In particular, this extension direction 4*a* is preferably at least partially parallel with respect to the expansion trajectory 2*a*.

In fact, the slider 4 is configured to interact with the frame 2.

The slider 4, as already mentioned, is preferably housed within the guide 32.

The slider 4 can therefore extend along the whole edge 31 or along part of it.

Furthermore, the slider 4 can be made continuous along the edge 31 of the membrane 3 or the membrane 3 can provide a plurality of consecutive sliders 4 included in the membrane 3.

Preferably, in the embodiment of FIGS. 1-2, the frame 2 is substantially a frame for the membrane 3 on which the fabric of the membrane 3 can be placed, for example by interlocking, of the slider 4 in the guide 32 with the protuberance 20 as better specified hereinafter.

The slider 4, in fact, comprises at least a receiving portion 40.

The receiving portion 40 can be a part of the slider 4 or it can be determined by the shape of the slider 4 itself.

In general, the receiving portion 40 is configured to at least partially house the protuberance 20.

In this way, the frame 2, the membrane 3 and the slider 4 are rigidly constrained at least one fixed point.

This constraint is possible since, since the slider 4 is inserted into the guide 32, at least part of the membrane 3 is blocked or trapped between the slider 4 and the frame 2 which are in turn blocked by the receiving portion 40 and the protuberance 20.

The chair 1 can also include a plurality of cursors 4 which may be constrained to the same protuberance 20 or also to respective protuberances 20, for example extending along parallel rows.

Or the same slider 4 can include two receiving portions 40 or even more, each configured to house a protuberance 20 or more protuberances 20, for example if defined by teeth 200.

The slider 4 can therefore be rigid. In this case, it is preferably that the slider 4 has an extension direction 4*a* which is parallel and superimposable to the expansion trajectory 2*a* in such a way as to make the coupling efficient.

Preferably, the slider 4 is deformable in such a way that the extension direction 4*a* can be rotated around any axis and can be made parallel, on command, with respect to the expansion trajectory 2*a*.

To favour the deformation of the slider 4 and the variation of the extension direction 4*a*, preferably the slider 4 comprises a plurality of notches 41.

The notches 41 are preferably through or non-through holes arranged on the extension surface of the slider 4.

Preferably, the notches 41 are perimeter and extend along planes perpendicular to the extension direction 4*a*.

In this way, the notches 41 favour the deformation, preferably elastic, of at least part of the slider 4 and at least the curvature of at least part of the extension direction 4*a*. Even more in detail, the notches 41 allow to easily flex at least part of the slider 4.

Preferably, moreover, the notches 41 extend along at least 20% of the perimeter section defined locally by the profiles defined by the sections along planes perpendicular to the extension direction 4*a*. Naturally, the notches 41 can also extend along more than 20%, even up to 90%, of the perimeter section defined locally by the profiles defined by the sections along planes perpendicular to the extension direction 4*a*. By increasing the extension of the notches 41, in general, the possibility of describing higher curvatures of the slider 4 is proportionally increased. Examples of more or less extended notches 41 are shown in FIG. 6.

The notches 41 can also be made in a manner alternating along the slider 4 in such a way as to be distributed alternately on two opposite sides, parallel to the extension direction 4*a*, of the slider 4. This configuration is shown, in particular, in FIG. 5.

The notches 41 can also define different shapes. For example, they can define substantially rectilinear shapes and therefore define rectilinear holes along the planes perpendicular to the extension direction 4*a*.

Or each of the notches 41 can define an isosceles triangle shape in which the vertex of the isosceles triangle to further increase the deformability.

The slider 4, depending on the configuration of the frame 2, can define different shapes.

For example, if the protuberance 20 is a tooth 200, the slider 4 can also consist of a simple rod, which can be inserted inside the guide 32. Preferably, in this case, the slider 4 can include at least one hole 42.

The hole 42 substantially forms the receiving portion 40. It can therefore be through or non-through.

The hole 42, in general, is preferably configured to house at least part of the tooth 200 and of the membrane 3. Basically, since the membrane 3 is fitted on the slider 4, the hole 42 is intended to include part of the membrane 3 which is pushed by the tooth 200 within the hole 42 or also partially perforated by the tooth 200 itself. Preferably, if perforation is foreseen, the secondary filaments 34 are sufficiently resistant not to be damaged during the perforation which, in fact, is carried out substantially by perforating the mesh, for example by separating two adjacent main filaments 33 with a tooth 200.

In this way, the membrane 3 is firmly fixed with respect to the slider 4 and to the frame 2 in at least one fixed point determined, in this case, by the tooth 200.

If, on the other hand, the protuberance 20 is a rail 201, the slider 4 can consist of or include a tubular element. The tubular element, like the rod described above, is substantially configured to be inserted into the guide 32.

Preferably, moreover, the tubular element is an open tubular element, extending along the direction of extension 4*a*, and therefore defining a profile 43. The profile 43 is preferably a C-shaped profile defined along planes perpendicular to the extension direction 4*a*.

The profile 43, therefore, forms the receiving portion 40. In fact, the profile 43 is configured to trap at least part of the rail 201 and of the membrane 3.

Also in this case, as in the previous example, the membrane 3 interposed between the rail 201 and the receiving portion is substantially trapped, or rather blocked at a plurality of fixed points extending along the extension direction 4*a*.

Even more in detail, preferably, the protuberance 20 and the tubular element are mutually counter-shaped.

In any case, the slider 4 can be extractable with respect to the guide 32, it can be constrained to the guide 32 when inserted or it can also be integrated inside the guide.

In particular, the slider 4 can be slidably constrained within the guide 32 in such a way as to be extractable along the direction of extension 4*a* from the membrane 3. Or, the slider 4 can be integrated into the membrane 3 and constrained within the guide 32 in such a way as to be locked along the direction of extension 4*a* with respect to the membrane 3.

This lock can be made with mechanical devices, for example expanding, which are activated when the slider 4 is inside the guide 32. Or they can be made simply from the outer surface of the slider 4.

In this sense, for example, the external surface could have such a roughness as to make it difficult for the slider 4 to slide within the membrane 3, in particular the guide 32.

The slider could also include reinforcing elements such as, for example, of the metal cables arranged at the ends of the profile 43 and extending along the direction of extension 4*a*. Alternatively, diaphragms could be provided to stiffen the grip of the profile 43 on the protuberance and reinforce the coupling, whether by sliding or clipping, of the slider 4 on the frame 2 to trap the membrane 3.

In any case, thanks to the coupling mechanism determined by frame 2, membrane 3 and slider 4, the chair 1 defines at least one sitting. Furthermore, the chair 1 preferably also defines a backrest.

The sitting, therefore, is defined by at least part of the support surface 30 and is the part generally subjected to greater tension than, for example, the backrest.

The membrane 3 preferably constrained to the frame 2 through the slider 4 included in the guide 32 can express its technological characteristics in a controlled manner. Basically, the membrane 3 is constrained to the frame 2 in such a way as to be constrained not in a compliant way, in at least one fixed point, at least in correspondence with the edge 31. This characteristic is important since the coupling between frame 2 and membrane 3 thus realized to allow of preventing the membrane 3 from moving on the frame 2 by delocalizing the portions with controlled behaviour 30*a* and nullifying the mechanical effects provided by the membrane 3. Preferably, the portions with controlled behaviour 30*a* are arranged in predetermined points of the backrest and seat. In particular, preferably, the membrane 3 which forms the backrest preferably includes several portions with controlled behaviour 30*a* each with different deformability to allow greater freedom and softness in the lower part and greater rigidity in the upper part.

In particular, for example, a first portion with controlled behaviour 30*a* is arranged in correspondence with the lumbar area of the user placed during the session, a second portion with controlled behaviour 30*a* is preferably arranged at the upper part of the thoracic backbone of the user during the session. and the third controlled behaviour portion 30*a* is disposed between the first and second controlled behaviour portion 30*a*.

In particular, preferably the first portion with controlled behaviour 30*a* and the second portion with controlled behaviour 30*a* include second filaments 34 with high elasticity so that said portions with controlled behaviour 30*a* are more deformable. The third portion with controlled behaviour 30*a* preferably includes at least one second rigid filament 34 in such a way that this portion with controlled behaviour 30*a* is more rigid at least than the other two portions with controlled behaviour 30*a* and not very deformable.

In this way, when the user places himself on the chair, the membrane 3 conforms to the lumbar and dorsal thoracic portion of the user's body without the frame 2 necessarily having to be shaped in this way. In fact, the load bearing is delegated to the membrane 3 and the conformation of the support surface 30 defines, with the portions with controlled behaviour 30*a*, the shape that the chair 1 can take, for example at least in correspondence with the backrest.

The same discourse can also be addressed for the seat. For example, more yielding lateral bulkheads can be provided in the seat, thus defining portions with controlled behaviour 30*a*, and a more rigid central support area, for example similar to the third portion with controlled behaviour 30*a* of the backrest or even more rigid, for example with a plurality of secondary filaments 34 arranged along the shoulder with stiffer filaments 34.

The coupling system determined by the slider 4, the frame 2 and the membrane 3 just described is of particular efficiency in an example of chair 1 as described below. In a preferred but not exclusive embodiment, the frame 2 defines a composite 3D curve or a curve made along an expansion trajectory 2*a* which rotates around at least two main axes in the three-dimensional space.

Preferably, the frame 2 defines a condition of use or assembly configuration wherein the closed structure is created and a rest condition or pre-assembly configuration in which it assumes a different shape.

In use or assembled configuration, preferably, the frame 2 is adapted to support the membrane 3 in tension in correspondence with at least part of the edge 31.

As already mentioned, in fact, the membrane 3 can be entirely connected to the frame 2 along its edge 31 or it can be connected only partially along its edge 31, for example in the case in which it is intended to define a chair 1 including part of the suspended membrane 3, as shown in FIG. 17.

This last expedient may also be appropriate if it is intended to make chair 1 with 3 different membranes. In fact, the chair 1 could comprise membranes 3 partly constrained to the frame 2 in the perimeter portions and partly constrained to other membranes 3 to form the support portion 30.

In particular, the frame 2 locally tends the membrane 3 in relation to the shape assumed by the frame 2 itself.

In the rest condition or pre-assembly configuration, on the other hand, the frame 2 releases the membrane 3.

In order to obtain this result, the frame 2 preferably, but not necessarily, comprises at least two parts 22.

The parts 22 are portions of the frame 2 which can substantially coincide with portions of the closed structure defined by the frame 2. Preferably, they are mutually separated and mutually constrained in a compliant way at two fixed points. Alternatively, they can be parts of a single piece defining points of weakness between the parts 22 which allow the individual parts 22 to be identified. In the latter case, the fixed points would correspond to the points of weakness. Preferably, these fixed points correspond to the end points of the parts 22, but other points, for example intermediate points, could be provided in such a way as to provide annular shapes with irregular edges.

Preferably, the parts 22 are mutually constrained in a compliant way by means of two hinges 23.

The hinges 23 are preferably the means suitable for allowing the switching of the conditions or configurations of use (assembly) or rest (pre-assembly) of the parts 22 or of the frame 2.

These hinges 23 are preferably mechanical.

In particular, preferably, the hinges 23 define the configuration of use, or of assembly, wherein the parts 22 actually form the frame 2 and the configuration of rest, or pre-assembly, in which the parts 22 are reciprocally folded like a book.

In this way, the overall dimensions of the frame 2 are reduced when the parts 22, or the frame 2, are in the rest or pre-assembly configuration.

The hinges 23 preferably each define a rotation axis 1*a*. The axis of rotation 1*a* preferably lies along the sagittal plane, which divides the closed structure into two substantially identical portions. In use, the sagittal plane conveniently contains the vertical direction.

The rotation axis 1*a* preferably defines the only degree of freedom granted to the parts 22 of the frame 2. Therefore, substantially, the parts 22 are adapted to rotate preferably exclusively around the rotation axis 1*a* of the hinges 23.

Conveniently, the rotation axes 1*a* of the two hinges 23 are mutually aligned. Therefore, the frame 2 is capable of being substantially closed, as occurs for a common book, in the rest or pre-assembly configuration, and of being reopened by identifying at least one use or assembled configuration corresponding to an equilibrium configuration. stable in which the frame 2 places the membrane 3 under tension.

In particular, the frame 2 places the membrane 3 under tension preferably only when the parts 22 are in the configuration of use.

In order to achieve the configuration of use, or assembled, or of stable equilibrium, the chair 1, in this embodiment example, is preferably configured to allow the reciprocal rotation of the parts 22 exclusively in one direction. In particular, the reciprocal rotation allowed is preferably opposite to the ground, in such a way as to allow the frame 2 to oppose a possible weight force of a body or a user placed on the support portion defined by the membrane 3.

With rotation opposite to the ground, it is meant that, when the frame 2 is open like a book, it faces the ground like a book that would allow its pages to face the ground, once opened.

In this sense, the chair 1 preferably provides, in a first embodiment, a particular configuration of the hinges 23.

In detail, and as can be seen in FIGS. 12-14, each of the hinges 23 includes interference portions 23*a*.

The interference portions 23*a* are preferably mutually interfering only when the parts 22 form the frame 2 in the configuration of use. Furthermore, they are oriented in such a way that when the user rests on the membrane 3 constrained to the frame 2, the interference portions 23*a* realize a mutual interference force proportional to the weight force of the user.

In other words, the interference portions 23*a* can be shoulders capable of colliding when the frame 2 is in use and the parts 22 are arranged in a stable equilibrium position and the interference force can be the interacting constraint reaction between the interference 23*a* facing each other.

Conveniently, the parts 22 realize the stable equilibrium position precisely thanks to the interference portions 23*a*.

In a more complex configuration, the hinges 23 may not be mechanical hinges, for example known as door hinges in the home, but may be hinges 23 suitable for allowing the elastic deformation of the parts 22 to be flexible.

In this sense, the parts 22 could even be, as already mentioned, part of a single closed piece and able to be folded in certain fixed points of flexibility. Application examples such as these are present, for example, in bearing-less systems wherein the permitted displacements of a hinge can be referred to deformations of the material rather than to the mechanical connections of the structure.

The hinges 23 could, moreover, also provide locking means suitable for mutually locking the parts 22, when in use or assembled configuration, in such a way as to ensure that they continue to keep the membrane 3 under tension.

Alternatively, the hinges 23 can include an elastic element, for example a spring, adapted to keep the parts 22 in the used or assembled configuration, if not stressed. In the latter case, the locking means could be configured to lock the parts 22, and therefore the frame 2, in the rest or pre-assembly configuration.

Or the interference portions 23*a* could, on the other hand, themselves comprise locking means. For example, the latter may include a pressure-lockable elastic mechanism adapted to block rotation around the hinge 23 as soon as the interference portions 23*a* collide. Furthermore, this mechanism could allow the parts 22 to be released and the hinges 23 to be released when subjected to pressure again. An example of this type could be a spring-loaded locking mechanism.

The membrane 3, as mentioned, is constrained to the frame 2 preferably in correspondence with at least part of its edge 31 by means of the slider 4 and the protuberance 20.

The parts 22 can therefore be different, or they can be mutually identical and specular with respect to the rotation axes 1*a*.

The latter embodiment is preferable above all in order to optimize the production of the parts 22. The latter are, in fact, preferably made of aluminium by means of three-dimensional extrusion. Obviously, the parts 22 could also be made of polymeric material, for example also extruded, or other materials that allow to produce hollow and continuous profiles with a non-coplanar development trajectory. In another type of embodiment, the parts 22, and therefore the frame 2, could be made by means of a composite structure, for example including a metal core covered with a different material, such as a polymeric material, for example by means of technologies such as injection moulding of polymer on metal core.

The support structure 10 comprises, in addition to the frame 2, also the support means 5.

The support means 5 are preferably adapted to support the suspended frame 2 and stably spaced from the ground. For example, typical support means 5 included in common chairs are constituted by the four, or less, support legs.

In the present embodiment, the support means 5 are preferably constituted by a tubular structure able to be connected to the frame 2. More generally, the support means 5 include hooking means 50.

The hooking means 50 are preferably able to detachably constrained and in a stable manner the frame 2 and the support means 5.

These hooking means 50 are preferably interlocking constraints able to connect the frame 2 and the support means 5 at points fixed predetermined in order to realize the support structure 10 of the chair 1.

More in detail, the frame 2 includes pins 21.

The pins 21 are preferably protruding towards the ground. Basically, the pins 21 are elements, for example cylindrical, which protrude from the frame 2 in order to interact with other external components.

These pins 21 are therefore preferably, at the same time, constrained to the frame 2 by means of known constraints such as riveting, bolting or other types of joints.

Alternatively, the pins 21 could be obtained directly on the frame 2.

The pins 21 can therefore be made of metallic or, preferably, polymeric material. For example, the pins 21 can be made with the injection moulding technology.

The hooking means 50 are therefore suitably configured to interact with the pins 21. In particular, preferably, the hooking means 50 include slots 51 structurally configured to accommodate the pins 21 so as to stably lock the frame 2 on the means of support 5. In particular, preferably, the chair 1 is configured in such a way that the weight of the frame 2, of the membrane 3 and of the slider 4 and, possibly, of a person or user placed on it, tends to maintain the frame 2 and the support means 5 mutually constrained and stably locked.

The support means 5, as mentioned, do not necessarily define a structure as described above, but can also include a configuration of a conventional type, for example cantilevered, or with four legs or of another type, as long as including, in this embodiment, hooking means 50 suitable for allowing the coupling of the frame 2 and the supporting means 5. In an alternative configuration of the chair 1, the parts 22 can comprise two protrusions 22, as shown for example in the FIGS. 9*a*-9*b*. In this case, for example, the chair 1 can be configured in such a way as to trap two different membranes 3, one of which is adapted to form the support surface 30 and/or the portions with controlled behaviour 30*a*, and of which the other it can be adapted to cover the bottom of the chair, as explicitly shown in FIG. 15.

The support means 5 can include a coupling device, possibly also an articulation typical of task chairs.

For example, the coupling device can be a body, as shown in FIG. 16, available on the bottom, with respect to the ground, of the frame 2 in such a way as to support the same, hiding part of the bottom of the chair 1, and allowing the frame 2 to any component of the support means 5. In fact, the coupling device could have its own stiffness, for example given by the fact that it consists of a metal or polymeric structure, such as to allow the coupling of the frame 2 with hooking means 5 such as the wheel supports of typical office chairs.

Therefore, the coupling device can be counter-shaped to the lower portion of the frame 2 and, in particular, it can have an edge counter-shaped to the protuberance 20 and can be counter-shaped to the final shape assumed by the surface of the membrane 3 constrained to the frame 2 through the slider 4. Obviously, the coupling device can include articulation mechanisms known in the current state of the art. Mechanisms of this type are known, for example, with the term Synchro-tilt.

The chair 1 comprises, in this embodiment example, preferably a tensioner 6.

The tensioner 6 can be part of the support means 5 and integrated within them or it can be an external element.

Preferably, the tensioner 6 is configured to stretch the resting surface 30 along predetermined fixed points in such a way that the membrane 3 defines at least two specific zones, or even more. Preferably the membrane 3, when stretched, defines at least a backrest and a sitting.

The tensioner 6 preferably includes a tubular element 60.

The tubular element 60 can therefore be hollow or even solid. Preferably it is U-shaped, or C-shaped, and is capable of exerting a tension on the support surface 30 and/or of the portions with controlled behaviour 30*a* along its extension.

The membrane 3 can therefore be arranged between the tensioner 6 and the ground in such a way that the tensioner 6 stretches the membrane 3 directly towards the ground itself.

Preferably, the membrane 3 includes a pocket 35. The pocket 35 is preferably configured to house at least part of the tubular element 60. In this way the tubular element 60, when subjected to displacements, integrally moves part of the membrane 3.

According to the shape of the pocket 35, moreover, the membrane 3 is stressed exclusively along the attachment points of the tubular element 60 to the pocket 35 or, if the pocket 35 completely covers the tubular element 60, the membrane 3 is stressed along the entire extension of the tubular element 60.

In this configuration preferably, the tubular element 60 is arranged below, with respect to the ground, the membrane 3 and inside the pocket 35 obtained on the fabric itself, as shown in FIG. 10.

Furthermore, the supporting means 5 can include second pins 52.

The second pins 52 are preferably of the same type as the pins 21 and perform substantially the same function.

In fact, preferably, the second pins 52 are housed inside the tubular element 60 and the latter is therefore configured to house them.

In addition, the support means 5 include constraint means 53.

The constraint means 53 are preferably configured to lock the tubular element 60 in a predetermined position towards the ground in which the tensioner 6 subjects the membrane 3 to a continuous tension.

Conveniently, the constraint means 53 are substantially interlocking means capable of trapping at least part of the tensioner 6 in such a way that it can remain stably disposed in a predetermined position by exercising its action in a continuous manner, as said.

In detail, the tensioner 6 can also define a curvature, or concavity towards the ground. The latter can, in fact, facilitate the coupling between the constraining means 53, maximizing their stability since the tensioner 6, once the user has rested on the membrane 3, exerts a force in accordance with the locking direction of the constraint means 53.

The realization of the seat and backrest is mainly obtained, in this example of embodiment, thanks to the tensioner 6. However, also the configurations of the frame 2 and of the membrane 3 contribute significantly to the technical aspects of the support structure 10, for example thanks to the different stiffnesses that the membrane 3 can assume also thanks to the shape of the frame 2 and to the firmly and stably bond made with it thanks to the slider 4 or the sliders 4.

The operation of the modular chair 1 previously described in structural terms it is substantially determined by the method of realization.

In fact, the invention includes a new realization method.

The method comprises at least one phase wherein the support structure is prepared. The support structure, as described, includes the frame 2.

Furthermore, the method comprises a phase wherein the membrane 3 is procured. In addition, the method comprises a step in which the slider 4 is inserted into the guide 32.

This insertion phase of the slider 4 can be carried out during the production of the membrane 3. For example, the membrane 3 can be woven directly on the slider 4 in such a way as to integrate the same inside the fabric of the membrane 3. Furthermore, the guide 32 thus made around the slider 4, it can include secondary filaments 34 wound directly around the slider 4.

Or, preferably, the membrane 3 can be made independently and the slider 4 can be subsequently inserted into the guide 32, for example during the assembly of the chair 1. Advantageously, the method comprises a further hooking phase wherein the receiving portion 40 is hooked onto the protuberance 20.

In this way, the frame 2, membrane 3 and slider 4 are integrally constrained in correspondence with at least one fixed point. As already mentioned, if the protuberance 20 includes a tooth 200, the tooth 200 fits into the hole 42 and pushes part of the membrane 3 into the hole 42.

If the protuberance 20 is a rail 201, the receiving portion 40 wraps at least part of the rail 201, trapping it.

The hooking can take place, in particular, by sliding the protuberance 20 of the receiving portion 40 or also by clipping, or rather interlocking, of the protuberance in the receiving portion 40.

The method can therefore comprise a further phase. If the slider 4 is constrained in the guide 32, the method may include a constraint phase between the insertion phase and the hooking phase.

In the constraint phase, preferably, the slider 4 and the guide 32 are mutually constrained in such a way as to lock the slider 4 and the guide 32 along the extension direction 4*a*.

The modular chair 1, and related manufacturing method, according to the invention achieve important advantages.

In fact, the chair 1 and the related manufacturing method allow to make the most of the new generation fabrics with variable localized behaviour, in a highly performing manner and therefore without reducing or nullifying the effectiveness of such fabrics. In fact, the portions with controlled behaviour are able to function correctly since the secondary filaments 34 which determine their behaviour are blocked at the edges 31 of the membrane 3 by means of the mechanism defined by slider 4, frame 2 and guide 32. Basically, the configurations of the frame 2, of the membrane 3 and of the slider 4 contribute significantly to the technical aspects of the seat and/or of the backrest, for example thanks to the different stiffnesses that the membrane 3 can assume thanks to or independently of the shape of the frame 2.

As mentioned, the membrane manufacturing technique, by means of machine knitting, allows to locally control the density and the conformation of the main filaments 33. The presence of the secondary filament 34, locked between the slider 4 and the frame, greatly enhances the mechanical control of the surface. support 30 in particular in the portions with controlled behaviour 30*a*.

Furthermore, the shape of the frame 2 can allow, and preferably allows, to subject the membrane 3 to different tensions along the edge 31.

In particular, the frame 2 can preferably take an approximately three-dimensional eight shape with the portion reserved for the seat wider compared to the portion reserved for the backrest.

In this way, a priori, the membrane 3 is stretched more in the area reserved for the seat. Therefore, it is possible to synergistically combine the technological possibilities provided by membrane 3, frame 2 and slider 4, in order to be able to define a supporting surface 30 controlled in each sector.

Conveniently, for example, the seat has a greater stiffness than the backrest and therefore a lower deformability.

A further advantage of the chair 1, and related manufacturing method, is given by the fact that they allow to constrain the membrane 3 determined by the fabric in a homogeneous way with respect to the frame 2 in such a way as not to alter the behaviour of the membrane 3 especially when specifically designed for use on the frame 2. In fact, any coupling mechanisms as known to those skilled in the art, involve the release of some parts of the fabric which can cause performance drops or even local breakages of the fabric itself.

Therefore, the chair 1 always remains comfortable over time and facilitates the adoption of a correct posture by a user.

The adoption of coupling mechanisms which include slider 4, frame 2 and membrane 3 as described allow, especially in the embodiment of the chair 1 shown, by way of example in the FIGS. 10-17 and previously described as an exemplary form, of favouring the recycling and disassembly of the chair 1 by making the chair 1 itself according to the invention a circular product.

In conclusion, the chair 1 is extremely long-lived, that is, less sensitive to the effects of wear, allowing reduced replacements and, at the same time, a high simplicity and cost-effectiveness of manufacture.

The invention is susceptible of variants falling within the scope of the inventive concept defined by the claims.

In this context, all the details can be replaced by equivalent elements and the materials, shapes and dimensions can be any.

The invention claimed is:

1. A modular chair comprising:

a support structure including a frame extending at least in part along an extension trajectory, the frame including at least one protuberance protruding in a direction incident to the extension trajectory;

a membrane including a support surface configured to support a user, an edge configured to be at least partially attached to said frame, and a tubular guide disposed at said edge; and a slider defining an extension direction at least partially parallel to said extension trajectory and accommodated within at least part of said guide, said slider including at least one receiving portion configured to accommodate at least part of said protuberance to firmly attach, at least one fixed point, said frame, said membrane, and said slider, the slider being configured to be deformed such that the extension direction is able to be rotated about any axis and is able to be made parallel, on command, to the extension trajectory.

2. The chair according to claim 1, wherein said extension trajectory rotates about at least two main axes in three-dimensional space such that said frame determines a complex curvilinear path extending in space in a three-dimensional way.

3. The chair according to claim 1, wherein said slider comprises a plurality of perimetric notches extending along planes that are perpendicular to said extension direction to allow the deformation of at least part of said slider and at least the curvature, on command, of at least part of said extension direction.

4. The chair according to claim 1, wherein said protuberance includes at least one tooth extending perpendicularly to said extension trajectory, and said slider comprises at least one hole defining said receiving portion and configured to accommodate at least part of said tooth and said membrane.

5. The chair according to claim 1, wherein said protuberance includes a bar extending continuously parallel to said extension trajectory, and said slider includes an open tubular element extending along said extension direction and defining a C-shaped profile along planes perpendicular to said extension direction making said receiving portion and configured to trap at least part of said bar and said membrane.

6. The chair according to claim 5, wherein said protuberance and said open tubular element are counter-shaped to each other.

7. The chair according to claim 1, wherein said slider is slidably bound within said guide such that the slider is configured to be extracted along said extension direction by said membrane.

8. The chair according to claim 1, wherein said slider is integrated into said membrane and attached within said guide such that the slider is locked along said extension direction in relation to said membrane.

9. The chair according to claim 1, wherein said membrane includes a periodic weave the base of which comprises at least one main filament woven into a mesh and said support surface comprises one or more portions with controlled behavior including said periodic weave in which at least one secondary filament is inserted, the at least one secondary filament being arranged in a weft along a predetermined trajectory to vary, in a controlled manner, the mechanical behavior of said support surface at said portions with controlled behavior by varying a type or a number of said at least one secondary filament.

10. The chair according to claim 9, wherein said at least one secondary filament defines at least one winding within said guide to create a row extending parallel to said guide at which said main filament and said at least one secondary filament are locked and joined to each other.

11. The chair according to claim 9, wherein said at least one secondary filament is woven within said weave at said guide to be hooked in English or in false English rib.

12. The chair according to claim 9, wherein said at least one secondary filament comprises at least one heat-shrink component configured such that a local tension of said portions with controlled behavior is configured to vary according to a heat to which said membrane is subjected.

* * * * *